US009703222B2

(12) United States Patent
Mine et al.

(10) Patent No.: US 9,703,222 B2
(45) **Date of Patent: *Jul. 11, 2017**

(54) TONER AND METHOD OF PRODUCING THE SAME

(71) Applicant: Konica Minolta, Inc., Tokyo (JP)

(72) Inventors: Tomoko Mine, Hino (JP); Kaori Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/150,523

(22) Filed: May 10, 2016

(65) Prior Publication Data

US 2016/0357123 A1 Dec. 8, 2016

(30) Foreign Application Priority Data

Jun. 3, 2015 (JP) ..... 2015-113055

(51) Int. Cl.
*G03G 9/08* (2006.01)
*G03G 9/097* (2006.01)
*G03G 9/087* (2006.01)

(52) U.S. Cl.
CPC ..... *G03G 9/09733* (2013.01); *G03G 9/0804* (2013.01); *G03G 9/08755* (2013.01); *G03G 9/08791* (2013.01)

(58) Field of Classification Search
CPC ..... G03G 9/08755; G03G 9/08733; G03G 9/08791
USPC ..... 430/109.4
See application file for complete search history.

(56) References Cited

U.S. PATENT DOCUMENTS

2016/0306286 A1* 10/2016 Mine ..... G03G 9/0804

FOREIGN PATENT DOCUMENTS

JP 2013105128 A 5/2013

* cited by examiner

*Primary Examiner* — Mark A Chapman
(74) *Attorney, Agent, or Firm* — Lucas & Mercanti, LLP

(57) ABSTRACT

An electrostatic latent image developing toner includes toner base particles including a binder resin and a nucleating agent, wherein the binder resin includes a hybrid crystalline resin having a structure in which a crystalline polyester resin unit and an amorphous resin unit are chemically bonded to each other, and the nucleating agent is at least one compound selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid.

14 Claims, 1 Drawing Sheet

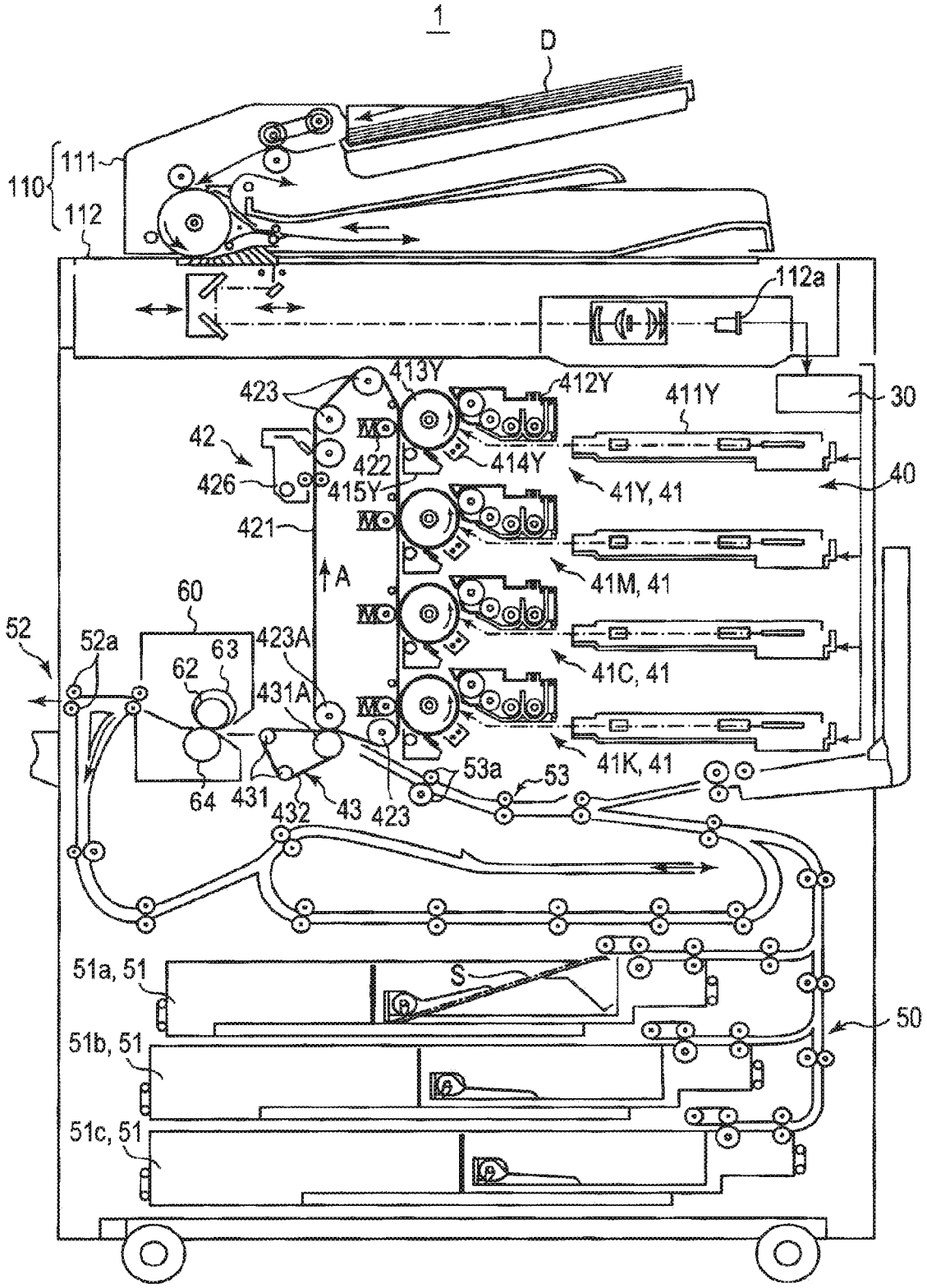
1
D
110
111
112
112a
30
423
413Y
412Y
411Y
42
422
414Y
426
415Y
41Y, 41
40
421
A
41M, 41
60
52
52a
63
423A
62
41C, 41
431A
41K, 41
53a
53
64
431
432
43
423
51a, 51
S
50
51b, 51
51c, 51

TONER AND METHOD OF PRODUCING THE SAME

The entire disclosure of Japanese Patent Application No. 2015-113055 filed on Jun. 3, 2015 including description, claims, drawings, and abstract are incorporated herein by reference in its entirety.

BACKGROUND OF THE INVENTION

Field of the Invention

The present invention relates to an electrostatic latent image developing toner and a method of producing the same.

Description of the Related Art

Electrophotographic image forming methods typically use a two-component developer (toner) including colorant-containing toner particles and carrier particles for mixing and carrying the toner particles. Such image forming methods are required to consume less thermal energy during fixation in order to increase the image forming speed and to reduce environmental impact. Therefore, toner particles are required to be fixed at lower temperature. For this purpose, it is generally known to add, to a binder resin, a crystalline resin such as crystalline polyester with high sharp-melting properties.

For example, in a binder resin including a crystalline polyester resin and an amorphous resin, the crystalline part of the crystalline polyester resin melts when the temperature of the binder resin is allowed to exceed the melting point of the crystalline polyester, for example, by heating during fixation. As a result, the crystalline polyester resin and the amorphous resin are compatibilized with each other so that low-temperature fixation of toner particles is achieved. Unfortunately, both resins in such toner particles can be compatibilized at a reaction temperature during the production of the toner particles, which softens the toner particles, so that the resulting toner can have insufficient storage stability.

A known measure to suppress the compatibilization during the production is to add, to a binder resin, a resin containing an introduced nucleating agent having a melting point higher than that of the binder resin. Concerning such a toner, for example, an electrostatic latent image developing toner is known which includes toner base particles including a binder resin, a compound A including a monoester compound, a compound B including at least one selected from a diester compound and a triester compound, and a nucleating agent (see, for example, JP 2013-105128 A).

The introduction of a nucleating agent into toner base particles is effective in facilitating the crystallization of the crystalline resin in the binder resin. On the other hand, however, the nucleating agent is difficult to disperse uniformly in the toner base particles. Therefore, for example, the crystalline resin can crystallize in the vicinity of the surface of the toner base particles, so that the toner particles can have an unsatisfactory level of uniform chargeability.

SUMMARY OF THE INVENTION

An object of the present invention is to provide a toner superior in low-temperature fixability, high-temperature storage stability, and uniform chargeability.

To achieve the abovementioned object, according to an aspect, an electrostatic latent image developing toner reflecting one aspect of the present invention comprises: toner base particles comprising a binder resin and a nucleating agent, wherein the binder resin comprises a hybrid crystalline resin having a structure in which a crystalline polyester resin unit and an amorphous resin unit are chemically bonded to each other, and the nucleating agent is at least one compound selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid.

To achieve the abovementioned object, according to an aspect, a method of producing an electrostatic latent image developing toner comprising toner base particles comprising a binder resin and a nucleating agent, reflecting one aspect of the present invention comprises the step of growing particles that are produced by aggregating particles of the binder resin and particles of the nucleating agent in an aqueous medium, wherein a hybrid crystalline resin having a structure in which a crystalline polyester resin unit and an amorphous resin unit are chemically bonded to each other is used to form the binder resin, and at least one compound selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid is used as the nucleating agent.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 1 is a diagram schematically showing the structure of an example of an image forming apparatus in which a toner according to an embodiment of the present invention is used.

DESCRIPTION OF THE PREFERRED EMBODIMENTS

Hereinafter, an embodiment of the present invention will be described with reference to the drawings. However, the scope of the invention is not limited to the illustrated examples.

An embodiment of the present invention is directed to an electrostatic latent image developing toner containing toner base particles including a binder resin and a nucleating agent.

The binder resin includes a hybrid crystalline resin. The hybrid crystalline resin has a structure in which a crystalline polyester resin unit and an amorphous resin unit are chemically bonded to each other.

The crystalline polyester resin unit refers to a crystalline polyester resin-derived part of the hybrid crystalline resin. The amorphous resin unit refers to a part of the hybrid crystalline resin, in which the part is derived from a non-crystalline resin (amorphous resin), such as a resin other than the crystalline polyester resin.

The crystalline polyester resin is a polyester having crystallinity. The crystallinity means that differential scanning calorimetry (DSC) shows a clear endothermic peak rather than stepwise endothermic changes. Specifically, the "clear endothermic peak" means that the endothermic peak has a half-width of 15° C. or less as measured at a rate of temperature rise of 10° C./min in DSC. The smaller half-width indicates the higher degree of crystallinity.

One or more crystalline polyester resins may be used. The crystalline polyester resin preferably has a melting point of 55 to 80° C. in order to ensure the ability to sufficiently soften and fix the toner at low temperature. The crystalline polyester resin more preferably has a melting point of 75 to 85° C. in order to improve various properties in a well-balanced manner.

The crystalline polyester resin is advantageous in that its melting point can be easily controlled. The melting point is preferably 55 to 80° C., more preferably 75 to 85° C. in order to allow the toner to have sufficient low-temperature fixability and high image storage stability. The melting point of the crystalline polyester resin can be controlled by the composition of the resin (e.g., the monomer type). The crystalline polyester can be obtained, for example, by a known synthetic method using a dehydration condensation reaction between a polycarboxylic acid and a polyalcohol.

Examples of the polycarboxylic acid include saturated aliphatic dicarboxylic acids such as succinic acid, sebacic acid, and dodecanedioic acid; alicyclic dicarboxylic acids such as cyclohexanedicarboxylic acid; aromatic dicarboxylic acids such as phthalic acid, isophthalic acid, and terephthalic acid; tri- or polycarboxylic acids such as trimellitic acid and pyromellitic acid; anhydrides of these acids; and C1 to C3 alkyl esters thereof. The polycarboxylic acid is preferably an aliphatic dicarboxylic acid.

Examples of the polyalcohol include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; and tri- or polyalcohols such as glycerin, pentaerythritol, trimethylolpropane, and sorbitol. The polyalcohol is preferably an aliphatic diol.

The amorphous resin has substantially no crystallinity and typically contains an amorphous part. One or more amorphous resins may be used. Examples of the amorphous resin include vinyl resins, urethane resins, urea resins, amorphous polyester resins, and partially modified polyester resins. The amorphous resin can also be obtained, for example, by a known synthetic method.

The vinyl resin is a resin produced by polymerization of a monomer or monomers including a vinyl group-containing compound or a derivative thereof. One or more vinyl resins may be used. Examples of the vinyl resin include styrene-(meth)acrylic resins.

The styrene-(meth)acrylic resins have the molecular structure of a radical polymer of a radically-polymerizable, unsaturated bond-containing compound, and can be synthesized, for example, by radical polymerization of such a compound. One or more such compounds may be used, examples of which include styrene, derivatives thereof, and (meth)acrylic acid and derivatives thereof.

Examples of the styrene and derivatives thereof include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the (meth)acrylic acid and derivatives thereof include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate.

In the hybrid crystalline resin, the crystalline polyester resin units and the amorphous resin units may be consecutively or randomly arranged, as long as a chemical bond is formed between the crystalline polyester resin units, between the amorphous resin units, or between these resin units. Both units may be linked in a chain, or a chain of one unit may be grafted with the other unit.

In this regard, the chemical bond is, for example, an ester bond or a covalent bond formed by addition reaction of unsaturated groups. The hybrid crystalline resin can be obtained by a known method of chemically bonding the crystalline polyester resin unit and the amorphous resin unit. For example, the binder resin can be produced by a method including the steps of polymerizing a bireactive monomer and a monomer for forming a main-chain resin unit and performing polymerization or reaction of one or both of a monomer for forming a side-chain resin unit and a nucleating agent in the presence of the resulting main chain precursor.

A substituent such as a sulfonate group, a carboxyl group, or a urethane group may be further introduced into the hybrid crystalline polyester resin. The site at which the substituent is introduced may be the crystalline polyester resin unit or the amorphous resin unit.

The structures and contents of the main and side chains in the resulting resin can be determined or estimated, for example, by subjecting the binder resin or a hydrolysate thereof to known instrumental analysis such as nuclear magnetic resonance (NMR) or electrospray ionization mass spectrometry (ESI-MS).

In the synthesis of the resin units, a chain transfer agent for controlling the molecular weight of the resulting resin may also be added to the raw materials such as the monomers for the resin units. One or more chain transfer agents may be used in such an amount as to achieve the object as long as the effects of the embodiment can be achieved. Examples of the chain transfer agent include 2-chloroethanol, mercaptans such as octyl mercaptan, dodecyl mercaptan, and tert-dodecyl mercaptan, and a styrene dimer.

The term "grafted" means that a chemical bond is formed between a polymer to forma backbone and a different type of polymer (or monomer) to form a branch. In order to totally improve the specific properties of the toner, the hybrid crystalline resin preferably has a structure in which the amorphous resin unit is grafted with the crystalline polyester resin unit. The hybrid crystalline resin of this structure is preferred in order to sufficiently increase the degree of crystallinity of the hybrid crystalline resin in the toner base particles.

The contents of the crystalline polyester resin unit and the amorphous resin unit in the hybrid crystalline resin may be determined, as appropriate, as long as the effects of the embodiment can be achieved. For example, if the content of the amorphous resin unit in the hybrid crystalline resin is too low, the hybrid crystalline resin may be insufficiently dispersed in the toner base particles, and if the content of the amorphous resin unit is too high, the low-temperature stability may be insufficient. From these points of view, the content is preferably 5 to 30% by weight, and the content is more preferably 5 to 20% by weight in order to improve the high-temperature storage stability and uniform chargeability.

From the same points of view, the content of the crystalline polyester resin unit in the hybrid crystalline resin is preferably 65 to 95% by weight, more preferably 70 to 90% by weight. The hybrid crystalline resin may further contain an additional component other than both units as long as the effects of the embodiment can be achieved. Examples of such an additional component include other resin units and various additives to be added to the toner base particles.

The nucleating agent is selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid. One or more of these nucleating agents may be used.

The nucleating agent preferably has a melting point higher than the melting point of the hybrid crystalline resin. The reason for this may be as follows. The hybrid crystalline resin for the toner is made compatible with the amorphous resin by heating in the process of producing the toner base particles. The hybrid crystalline resin is then cooled in a later step of the process of producing the toner base particles. In this process, the crystallization of the nucleating agent in the toner base particles is first allowed to proceed, so that uniform crystal nuclei are produced. On the crystal nuclei, the hybrid crystalline resin molecules are arranged, for example, in a folded fashion, so that they grow crystals. In this way, uniform fine crystals form rapidly. It is therefore conceivable that high-temperature storage stability increases as the crystallization proceeds sufficiently and that since the crystals are fine enough, sufficient low-temperature fixability is obtained.

From the above points of view, the melting point Tcc of the nucleating agent is preferably, for example, 2 to 25° C. higher, more preferably 4 to 15° C. higher than the melting point Tc of the hybrid crystalline resin. The Tcc is preferably 50 to 100° C., more preferably 65 to 78° C., in order simultaneously to allow the toner to have appropriate fixability and to allow the nucleating agent to function.

If the content of the nucleating agent in the toner base particles is too low, the effect of the nucleating agent may be insufficient. If the content is too high, the hybrid crystalline resin may be insufficiently incorporated into the inside of the toner base particles. If the incorporation is insufficient, the hybrid crystalline resin will be more likely to be exposed at the surface of the toner base particles, so that the toner may have insufficient chargeability and insufficient high-temperature storage stability. In order to sufficiently disperse the nucleating agent in the inside of the toner base particles, the content of the nucleating agent is preferably 0.1 to 10% by weight, more preferably 1 to 8% by weight.

The binder resin, which consists essentially of the hybrid crystalline resin and the nucleating agent, may further contain an additional component other the hybrid crystalline resin and the nucleating agent as long as the effects of the embodiment can be achieved. Examples of the additional component include an amorphous resin. One or more amorphous resins may be used. The amorphous resin may be one mentioned above for the amorphous resin unit. The binder resin preferably further contains the amorphous resin so that both of the high-temperature storage stability and the uniform chargeability of the toner can be improved at the same time. From the above points of view, the amorphous resin is more preferably a vinyl resin.

When the binder resin further contains the additional component such as the amorphous resin, the content of the hybrid crystalline resin in the binder resin is preferably 1 to 30% by weight, more preferably 5 to 20% by weight, in order to improve the low-temperature fixability and the high-temperature storage stability.

The content of each of the resins or each unit in the binder resin can be determined or estimated by known instrumental analysis such as NMR or methylation pyrolysis-gaschromatography/mass-spectrometry (P-GC/MS). The type and content of the nucleating agent can be determined or estimated, for example, by a method using a known analytical instrument such as a high-performance liquid chromatograph-mass spectrometer or a gas chromatograph-mass spectrometer.

The toner includes toner base particles each containing the binder resin and the nucleating agent. The toner base particles may each further contain an additional component other than the binder resin as long as the effects of the embodiment can be achieved. Examples of the additional component include a colorant, a release agent, and a charge control agent. One or more additional components may be used.

One or more colorants may be used. The colorant may be a known inorganic or organic colorant for use in color toner. Examples of the colorant include carbon black, magnetic materials, pigments, and dyes.

Examples of the carbon black include channel black, furnace black, acetylene black, thermal black, and lamp black. Examples of the magnetic materials include ferromagnetic metals such as iron, nickel, and cobalt, alloys containing any of these metals, and ferromagnetic metal compounds such as ferrite and magnetite.

Examples of the pigments include C.I. Pigment Red 2, 3, 5, 7, 15, 16, 48:1, 48:3, 53:1, 57:1, 81:4, 122, 123, 139, 144, 149, 166, 177, 178, 208, 209, 222, 238, and 269, C.I. Pigment Orange 31 and 43, C.I. Pigment Yellow 3, 9, 14, 17, 35, 36, 65, 74, 83, 93, 94, 98, 110, 111, 138, 139, 153, 155, 180, 181, and 185, C.I. Pigment Green 7, C.I. Pigment Blue 15:3, 15:4, and 60, and phthalocyanine pigments containing zinc, titanium, magnesium, or any other central metal.

Examples of the dyes include C.I. Solvent Red 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176, and 179, pyrazolotriazole azo dyes, pyrazolotriazole azomethine dyes, pyrazolone azo dyes, pyrazolone azomethine dyes, C.I. Solvent Yellow 19, 44, 77, 79, 81, 82, 93, 98, 103, 104, 112, and 162, and C.I. Solvent Blue 25, 36, 60, 70, 93, and 95.

Examples of the release agent (wax) include hydrocarbon waxes and ester waxes. Examples of the hydrocarbon waxes include low-molecular-weight polyethylene waxes, low-molecular-weight polypropylene waxes, Fischer-Tropsch waxes, microcrystalline waxes, and paraffin waxes. Examples of the ester waxes include carnauba wax, pentaerythritol behenate, behenyl behenate, and behenyl citrate.

Examples of the charge control agent include nigrosine dyes, metal salts of naphthenic acid or higher fatty acids, alkoxylated amines, quaternary ammonium salt compounds, azo-metal complexes, and metal salts of salicylic acid or metal complexes thereof.

In order to appropriately control the particle size and the circularity, the toner base particles are preferably polymerized toner particles prepared in an aqueous medium, rather than crushed toner particles, more preferably toner base particles produced by emulsion association aggregation method.

The toner particles each include, for example, the toner base particle and an external additive on the surface of the base particle. The toner particles preferably contain an external additive in order to control the fluidity, electrostatic chargeability, and other properties of the toner particles. One or more external additives may be used. Examples of the external additive include silica particles, titania particles, alumina particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles.

The external additive more preferably includes silica particles prepared by sol-gel method. Silica particles prepared by sol-gel method are characterized by having a narrow particle size distribution and therefore are preferred in order to reduce variations in the adhering strength of the external additive to the toner base particles.

The silica particles preferably have a number average primary particle size of 70 to 200 nm. Silica particles with a number average primary particle size in this range are generally larger than other external additives. Therefore, such silica particles can serve as spacers in a two-component developer. Therefore, such silica particles are preferred in order to prevent other smaller external additives from being embedded in toner base particles when the two-component developer is stirred in a developing apparatus. Such silica particles are also preferred in order to prevent fusion between toner base particles.

The number average primary particle size of the external additive can be determined, for example, through the processing of an image taken with a transmission electron microscope, and can be controlled, for example, by classification or mixing classified products.

The external additive preferably has a hydrophobized surface. The hydrophobization can be performed using a known surface-treatment agent. One or more surface-treatment agents may be used, examples of which include a silane coupling agent, a silicone oil, a titanate coupling agent, an aluminate coupling agent, a fatty acid, metal salts of fatty acids, esters thereof, and rosin acids.

Examples of the silane coupling agent include dimethyldimethoxysilane, hexamethyldisilazane (HMDS), methyltrimethoxysilane, isobutyltrimethoxysilane, and decyltrimethoxysilane. Examples of the silicone oil include cyclic, linear, or branched organosiloxanes and more specifically include organosiloxane oligomers, octamethylcyclotetrasiloxane, decamethylcyclopentasiloxane, tetramethylcyclotetrasiloxane, and tetravinyltetramethylcyclotetrasiloxane.

Examples of the silicone oil also include highly reactive silicone oils whose end is at least modified by introducing a modifying group or groups at a side chain, one end, both ends, one end of a side chain, both ends of a side chain, or other sites. One or more modifying groups may be used, examples of which include alkoxy, carboxyl, carbinol, higher fatty acid modifiers, phenol, epoxy, methacryl, and amino.

The content of the external additive is preferably 0.1 to 10.0% by weight, more preferably 1.0 to 3.0% by weight, based on the total weight of the toner particles.

When the toner is a one-component developer, the toner is composed of the toner particles themselves. When the toner is a two-component developer, the toner is composed of the toner particles and carrier particles. The content of the toner particles in the two-component developer (the toner concentration) may be the same as in common two-component developers, which is, for example, 4.0 to 8.0% by weight.

The carrier particle includes a magnetic material. Examples of the carrier particle include a coated carrier particle including a core particle made of the magnetic material and a coating material layer formed over the surface of the core particle; and a resin dispersion type carrier particle including a resin and a magnetic fine powder dispersed in the resin. The carrier particle is preferably the coated carrier particle in order to suppress the adhesion of the carrier particle to the photoreceptor.

The core particle includes a magnetic material such as a material capable of being magnetized strongly in the direction of a magnetic field being applied. One or more magnetic materials may be used, examples of which include ferromagnetic metals such as iron, nickel, and cobalt, alloys or compounds containing any of these metals, and alloys capable of becoming ferromagnetic upon a heat treatment.

Examples of the ferromagnetic metal or the compound containing it include iron, a ferrite represented by formula (a) below, and a magnetite represented by formula (b) below. In formulae (a) and (b), M represents one or more monovalent or divalent metals selected from the group of Mn, Fe, Ni, Co, Cu, Mg, Zn, Cd, and Li.

$$MO.Fe_2O_3 \qquad \text{Formula (a)}$$

$$MFe_2O_4 \qquad \text{Formula (b)}$$

Examples of the alloy capable of becoming ferromagnetic upon a heat treatment include Heusler alloys such as manganese-copper-aluminum and manganese-copper-tin, and chromium dioxide.

The core particle preferably includes any of various ferrites. This is because the coated carrier particle, which has a specific gravity smaller than that of the metal of the core particle, can keep the stirring impact force at a smaller level in a developing apparatus.

One or more coating materials may be used. The coating material may be a known resin for use in coatings on core particles for carrier particles. The coating material is preferably a cycloalkyl group-containing resin in order to reduce the water-adsorbing property of the carrier particle and to increase the adhesion between the coating layer and the core particle. Examples of the cycloalkyl group include cyclohexyl, cyclopentyl, cyclopropyl, cyclobutyl, cycloheptyl, cyclooctyl, cyclononyl, and cyclodecyl. In particular, cyclohexyl or cyclopentyl is preferred, and cyclohexyl is more preferred in view of the adhesion between the coating layer and the ferrite particle.

The cycloalkyl group-containing resin typically has a weight average molecular weight Mw of 10,000 to 800,000, more preferably 100,000 to 750,000. The content of the cycloalkyl group in the resin is, for example, 10% by weight to 90% by weight. The content of the cycloalkyl group in the resin can be determined using known instrumental analysis such as P-GC/MS or $^1$H-NMR.

The two-component developer can be produced by mixing appropriate amounts of the toner particles and the carrier particles. Examples of the mixing apparatus for use in the mixing include a Nauta mixer, a W cone mixer, and a V-shaped mixer.

The size and shape of the toner particles may be determined, as appropriate, as long as the effects of the embodiment can be achieved. For example, the toner particles have a volume average particle size of 3.0 to 8.0 μm and an average circularity of 0.920 to 1.000.

The number average particle size of the toner particles can be determined by measurement and calculation using an apparatus including Multisizer 3 (manufactured by Beckman Coulter, Inc.) and a data processing computer system connected thereto. The number average particle size of the toner particles can be controlled by, for example, controlling the temperature and stirring conditions in the production of the toner particles, classifying the toner particles, mixing classified toner particles, or other methods.

The average circularity of the toner particles can be determined, for example, by a process that includes observing a predetermined number of toner particles with a flow particle image analyzer FPIA-3000 (manufactured by SYSMEX CORPORATION) to determine the circumference length L1 of a circle having the same projected area as each particle image and to determine the circumference length L2 of each particle projection image, calculating the circularity C from L1 and L2 according to the formula below, and dividing the sum of the circularities C by the predetermined number. The average circularity of the toner particles can be controlled by, for example, controlling the degree of aging of resin particles in the production of the toner particles, heat-treating the toner particles, mixing toner particles with different circularities, or other methods.

$$C=L1/L2 \quad \text{(Formula)}$$

The size and shape of the carrier particles may also be determined, as appropriate, as long as the effects of the embodiment can be achieved. For example, the carrier particles have a volume average particle size of 15 to 100 μm. The volume average particle size of the carrier particles can be measured, for example, by a wet method using a laser diffraction particle size distribution analyzer HELOS KA (manufactured by Japan Laser Corporation). The volume average particle size of the carrier particles can be controlled by, for example, a method of controlling the conditions of producing the core particles to control the size of the core particles, classifying the carrier particles, mixing classified carrier particles, or other methods.

The toner can be produced, for example, by a method including the step of growing particles that are produced by aggregating particles of the binder resin and particles of the nucleating agent in an aqueous medium.

The production method may further include the steps of dispersing, aggregating, and fusing the above additional component in an appropriate form in an aqueous medium. For example, all the production methods may further include the steps of further dispersing additional resin fine particles in the aqueous medium, wherein the additional resin fine particles include a resin component in which the additional component such as the colorant is dispersed, and aggregating and fusing the additional resin fine particles to the resin fine particles in the aqueous medium.

All the production methods may further include a step suitable for the form of the toner. For example, all the production methods may further include one or both of the step of mixing the external additive with the toner base particles and the step of mixing the toner particles with the carrier particles.

In the toner, the nucleating agent can be easily incorporated into the inside of the toner base particles. This may be because of gathering due to the affinity between the hybrid crystalline resin and the nucleating agent. The nucleating agent has a relatively long alkyl chain. On the other hand, the hybrid crystalline resin generally has molecular structures capable of being mutually arranged with regularity, such as linear alkyl chains or linear molecular structures. The linear molecular structures of both materials generally have a relatively high affinity for each other. Therefore, the hybrid crystalline resin approaches the nucleating agent in the toner base particle, and is arranged at a relatively central part of the toner base particle.

The tendency of the nucleating agent and the hybrid crystalline resin to be arranged in this way in the toner base particle would be more significant in a case where the binder resin further contains the amorphous resin and the hybrid crystalline resin contains the amorphous resin unit in its main chain.

In this regard, the above affinity may be due to, for example, molecular structural similarity or interaction between polar functional groups (such as Van der Waals force or hydrogen bonding).

During the solidification of the binder resin, the nucleating agent rapidly crystallizes in the toner base particle to enhance the crystallization of the hybrid crystalline resin. During the melting of the binder resin, the nucleating agent melts as the hybrid crystalline resin rapidly melts. In this way, enhancement of the crystallization and sharp melting are achieved in the binder resin.

In the toner, the toner base particles contain the hybrid crystalline resin together with the nucleating agent. Therefore, the toner has an improved ability to incorporate the resin into the toner based particles. This allows the toner to have good uniform chargeability. In addition, the nucleating agent in the toner base particles facilitates the crystallization of the hybrid crystalline resin. This makes it possible to suppress plasticization of the toner base particles, which would otherwise be caused by compatibilization of the amorphous resin and the hybrid crystalline resin at the production stage, so that the toner can have good high-temperature storage stability.

In addition, the nucleating agent in the toner base particles can increase the rate of crystal nuclei formation during the cooling of the toner base particles. This makes it possible to increase the number of crystal nuclei in the toner base particles, so that the hybrid crystalline resin can form uniform fine crystals in the toner base particles. This allows the toner to also have high sharp-melting properties. Thus, the toner can have good low-temperature fixability not only on common smooth recording media but also on recording media with a rugged surface, such as embossed paper.

As understood from the above description, the toner includes toner base particles containing a binder resin and a nucleating agent, in which the binder resin includes a hybrid crystalline resin having a structure in which a crystalline polyester resin unit and an amorphous resin unit are chemically bonded to each other, and the nucleating agent is at least one compound selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid. Thus, the toner is superior in low-temperature fixability, high-temperature storage stability, and uniform chargeability.

The hybrid crystalline resin may have a structure in which the amorphous resin unit is grafted with the crystalline polyester resin unit. This structure is more effective in improving all of the low-temperature fixability, high-temperature storage stability, and uniform chargeability of the toner.

The nucleating agent having a melting point higher than that of the hybrid crystalline resin is more effective in facilitating the solidification of the binder resin.

The hybrid crystalline resin may contain 5 to 30% by weight of the amorphous resin unit. This content is more effective in improving both the low-temperature fixability and the high-temperature storage stability of the toner.

The binder resin may contain 1 to 30% by weight of the hybrid crystalline resin. This content is more effective in improving the uniform chargeability and the high-temperature storage stability of the toner.

The binder resin may further contain an amorphous resin. This feature is more effective in improving both the high-temperature storage stability and the uniform chargeability. The use of a vinyl resin as the amorphous resin is further more effective in this regard.

The toner producing method is a method of producing an electrostatic latent image developing toner including the toner base particles. The method includes the step of growing particles that are produced by aggregating particles of the binder resin and particles of the nucleating agent in an aqueous medium. The method makes it possible to obtain the toner superior in low-temperature fixability, high-temperature storage stability, and uniform chargeability.

The toner is suitable for use in common electrophotographic image forming methods. For example, the toner is stored in an image forming apparatus shown in the FIGUREand used to form a toner image on a recording medium.

The image forming apparatus 1 shown in the FIGUreincludes an image reading unit 110, an image processing unit 30, an image forming device 40, a sheet feeding unit 50, and a fixing device 60.

The image forming device 40 includes image forming units 41Y, 41M, 41C, and 41K configured to form toner images in colors Y (yellow), M (magenta), C (cyan), and K (black), respectively. These units have the same structure except for the toner stored. Therefore, hereinafter the reference signs representing the colors will be omitted in some cases. The image forming device 40 further includes an intermediate transfer unit 42 and a secondary transfer unit 43. These units correspond to a transfer device.

The image forming units 41 each include an exposure device 411, a developing device 412, a photoreceptor drum 413, a charging device 414, and a drum cleaning device 415. The photoreceptor drum 413 is, for example, a negatively chargeable organic photoreceptor. The surface of the photoreceptor drum 413 has photoconductivity. The photoreceptor drum 413 corresponds to a photoreceptor. The charging device 414 is, for example, a corona charger. The charging device 414 may also be a contact charging device that is configured to charge the photoreceptor drum 413 by bringing a contact charging member such as a charging roller, a charging brush, or a charging blade into contact with the photoreceptor drum 413. The exposure device 411 includes, for example, a semiconductor laser as a light source and a light deflector (polygon motor) that is configured to irradiate the photoreceptor drum 413 with a laser beam corresponding to the image to be formed.

The developing device 412 is a two-component developing device. The developing device 412 includes, for example, a developer container configured to store a two-component developer, a developing roller (magnetic roller) provided rotatably at the opening of the developer container, a diaphragm provided to partition the developer container in such a way that the two-component developer can pass therethrough, a feed roller adapted to feed the two-component developer from the opening side of the developer container to the developing roller, and a stirring roller adapted to stir the two-component developer in the developer container. The developer container stores the toner as the two-component developer.

The intermediate transfer unit 42 includes an intermediate transfer belt 421, a primary transfer roller 422 configured to presses the intermediate transfer belt 421 into contact against the photoreceptor drum 413, a plurality of support rollers 423 including a backup roller 423A, and a belt cleaning device 426. The intermediate transfer belt 421 is strung in a loop around the plurality of support rollers 423. As at least one driving roller among the plurality of support rollers 423 rotates, the intermediate transfer belt 421 travels at a constant speed in the direction of the arrow A.

The secondary transfer unit 43 includes an endless secondary transfer belt 432 and a plurality of support rollers 431 including a secondary transfer roller 431A. The secondary transfer belt 432 is strung in a loop around the secondary transfer roller 431A and the support rollers 431.

The fixing device 60 includes, for example, a fixing roller 62, an endless heat-generating belt 63 provided to cover the outer surface of the fixing roller 62 and to heat and melt the toner used to form a toner image on a sheet S, and a pressure roller 64 provided to press the sheet S against the fixing roller 62 and the heat-generating belt 63. The sheet S corresponds to the recording medium.

The image forming apparatus 1 further includes an image reading unit 110, an image processing unit 30, and a sheet feeding unit 50. The image reading unit 110 includes a sheet supply device 111 and a scanner 112. The sheet feeding unit 50 includes a sheet supply unit 51, a sheet discharge unit 52, and a feed path unit 53. The three sheet supply tray units 51*a* to 51*c* of the sheet supply unit 51 each store each preset type of sheets S (standard or special sheets) identified based on basis weight, size, or other features. The feed path unit 53 has a plurality of feed roller pairs such as resist roller pairs 53*a*.

How images are formed by the image forming apparatus 1 will be described.

The scanner 112 optically scans and reads a document D on a contact glass. Light reflected from the document D is read by a CCD sensor 112*a* to produce input image data. The input image data is subjected to certain image processing in the image processing unit 30, and the resulting data is sent to the exposure device 411.

The photoreceptor drum 413 rotates at a constant speed. The charging device 414 uniformly negatively charges the surface of the photoreceptor drum 413. In the exposure device 411, the polygon mirror of the polygon motor rotates at a high speed, and laser beams corresponding to the input image data for respective color components are emitted along the axial direction of the photoreceptor drum 413 and applied along the axial direction onto the outer surface of the photoreceptor drum 413. In this way, an electrostatic latent image is formed on the surface of the photoreceptor drum 413.

In the developing device 412, the toner particles are charged as the two-component developer in the developer container is stirred and fed. The two-component developer is then fed to the developing roller and forms a magnetic brush on the surface of the developing roller. The charged toner particles transfer from the magnetic brush and electrostatically adhere to the part of the electrostatic latent image on the photoreceptor drum 413. Thus, the electrostatic latent image on the surface of the photoreceptor drum 413 is made visible, and a toner image corresponding to the electrostatic latent image is formed on the surface of the photoreceptor drum 413.

The toner image on the surface of the photoreceptor drum 413 is transferred onto the intermediate transfer belt 421 by the intermediate transfer unit 42. After the image is transferred, residual toner remaining on the surface of the photoreceptor drum 413 is removed away by the drum cleaning device 415 having a drum cleaning blade that slides in contact with the surface of the photoreceptor drum 413.

The intermediate transfer belt 421 is pressed into contact with the photoreceptor drum 413 by the primary transfer roller 422, so that a primary transfer nip is formed by the photoreceptor drum 413 and the intermediate transfer belt 421 for each of the photoreceptor drums. In the primary transfer nip, toner images in the respective colors are sequentially superimposed and transferred onto the intermediate transfer belt 421.

On the other hand, the secondary transfer roller 431A is pressed against the backup roller 423A with the intermediate transfer belt 421 and the secondary transfer belt 432 interposed therebetween. As a result, a secondary transfer nip is formed by the intermediate transfer belt 421 and the secondary transfer belt 432. The sheet S is allowed to pass through the secondary transfer nip. The sheet S is fed to the secondary transfer nip by the sheet feeding unit 50. The timing of correcting the skew of the sheet S and feeding the sheet is adjusted by a resist roller unit provided with the resist roller pairs 53*a*.

When the sheet S is fed to the secondary transfer nip, a transfer bias is applied to the secondary transfer roller 431A. When the transfer bias is applied, the toner image carried on the intermediate transfer belt 421 is transferred onto the sheet S. The sheet S with the toner image transferred thereon is fed to the fixing device 60 by the secondary transfer belt 432.

The fixing device 60 forms a fixing nip by using the heat-generating belt 63 and the pressure roller 64, and heats and presses the sheet S in the fixing nip when the sheet S is fed to it. The toner particles in the toner image on the sheet S are heated, so that the nucleating agent and the hybrid crystalline resin rapidly melt inside the particles. As a result, the toner particles entirely melt rapidly with a relatively small amount of heat, and the toner components adhere to the sheet S. In the adhering molten toner components, the nucleating agent and its surrounding part crystallize rapidly, so that the components entirely solidify rapidly. In this way, the toner image is rapidly fixed on the sheet S with a relatively small amount of heat. The sheet S with the toner image fixed thereon is discharged to the outside of the machine by the sheet discharge unit 52 having sheet discharge rollers 52*a*. In this way, a high-quality image is formed.

After the secondary transfer, the toner residue remaining on the surface of the intermediate transfer belt 421 is removed by the belt cleaning device 426 having a belt cleaning blade that slides in contact with the surface of the intermediate transfer belt 421.

In the embodiment, the hybrid crystalline resin is used as a crystalline resin material to form the toner base particles, to which the nucleating agent is further added. In the toner base particles, the amorphous resin unit generally has a high affinity for a binder resin containing an amorphous resin such as a styrene-acrylic resin. This feature significantly improves the ability of the crystalline resin to be incorporated into the toner base particles. In addition, the nucleating agent is further added, which allows the crystalline resin to form uniform fine crystals in the toner base particles. This further improves the sharp melting property of the toner. As a result, the toner has a sufficient level of low-temperature fixability even on recording media with a rugged surface, such as embossed paper. According to the embodiment, therefore, there can be provided an electrostatic latent image developing toner having a sufficient level of low-temperature fixability even on recording media with a rugged surface and also having a sufficient level of high-temperature storage stability and uniform chargeability.

EXAMPLES

The present invention will be more specifically described with reference to the examples and comparative examples below. It will be understood that the examples and other information provided below are not intended to limit the present invention.

[Measurement Methods]

(Observation with Transmission Electron Microscope (TEM))

The microstructure of the binder resin and the nucleating agent in the toner base particles was observed as described below using a transmission electron microscope (TEM). First, the toner base particles were sufficiently dispersed and then embedded in a room-temperature curable epoxy resin. Subsequently, after the product was dispersed in a styrene fine powder with a particle size of about 100 nm, the resulting mixture was subjected to pressure molding to form a toner-containing block. Subsequently, after the formed block was stained with osmium tetraoxide, as needed, measurement samples were prepared by cutting 80- to 200-nm-thick slices from the block with a microtome having a diamond blade. Subsequently, the measurement slice sample was placed in a TEM, where a photograph was taken of the cross-sectional structure of the toner base particles. The electron microscope was used at a magnification of 5,000 times.

(Melting Point (Tc) and Glass Transition Temperature (Tg) of Each Resin)

The melting point and glass transition temperature of each resin used to form the toner are determined by subjecting each resin to differential scanning calorimetry. For example, a differential scanning calorimeter Diamond DSC (manufactured by PerkinElmer, Inc.) is used in the differential scanning calorimetry. The measurement is performed under measurement conditions (heating and cooling conditions) including a first heating process in which the temperature is raised at a rate of 10° C./min from room temperature (25° C.) to 150° C. and isothermally held at 150° C. for 5 minutes, a cooling process in which the temperature is cooled at a rate of 10° C./min from 150° C. to 0° C. and isothermally held at 0° C. for 5 minutes, and a second heating process in which the temperature is raised at a rate of 10° C./min from 0° C. to 150° C., in which the first heating process, the cooling process, and the second heating process are performed in this order. The measurement is performed using 3.0 mg of the toner, which is sealed in an aluminum pan and then placed in the sample holder of the differential scanning calorimeter Diamond DSC. An empty aluminum pan is used as a reference.

In the measurement, the melting point (Tc) of the resin is defined as the top temperature of the melting peak of the resin in the first heating process (the endothermic peak with a half-width of 15° C. or less). The glass transition temperature Tg1 (° C.) of the amorphous resin is defined as the onset temperature determined from the endothermic curve obtained from the first heating process in the measurement. The Tg2 (° C.) of the amorphous resin is defined as the onset temperature obtained from the second heating process in the measurement.

(Measurement of Weight Average Molecular Weight (Mw))

The weight average molecular weight (Mw) of each resin (expressed as the polystyrene-equivalent value) is determined using HLC-8220 (manufactured by Tosoh Corporation) as a gel permeation chromatography (GPC) system and three sets of TSKguardcolumn+TSKgel SuperHZM-M (manufactured by Tosoh Corporation) as columns. The column temperature is held at 40° C., and tetrahydrofuran (THF) is allowed to flow as a carrier solvent at a rate of 0.2 mL/min. The measurement sample of the resin is dissolved at a concentration of 1 mg/mL in THF under conditions where the dissolving treatment is performed at room temperature for 5 minutes using an ultrasonic disperser. The resulting solution is treated with a membrane filter with a pore size of 0.2 μm to give a sample solution. Subsequently, 10 μL of the sample solution is injected together with the carrier solvent into the GPC system. Each component of the resin is then detected using a refractive index detector (RI detector), and the molecular weight distribution of the measurement sample is calculated using a calibration curve, which is determined with monodisperse polystyrene standard particles.

The calibration curve is prepared by measuring at least ten standard polystyrene samples including, for example, standard polystyrene samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ for calibration curve measurement, manufactured by Pressure Chemical Company. The detector used in this measurement is a refractive index detector.

(Average Particle Size of Resin Particles, Colorant Particles, and Other Materials)

The volume average particle size (volume median diameter) of resin particles, colorant particles, and other materials was measured with UPA-150 (manufactured by Microtrac-BEL Corp.).

[Preparation of Dispersion Dw of Release Agent Particles]

A solution was obtained by mixing 60 parts by weight of behenic acid behenate (melting point 73° C.) as a release agent, 5 parts by weight of an ionic surfactant NEOGEN RK (manufactured by DKS Co. Ltd.), and 240 parts by weight of ion-exchanged water. The solution was heated at 95° C. and sufficiently dispersed using a homogenizer ULTRA-TURRAX T50 (manufactured by IKA). The dispersion was then subjected to a dispersion treatment using a pressure discharge-type Gorlin homogenizer, so that a dispersion Dw containing 20 parts by weight of the solid of the release agent particles was obtained. In the dispersion Dw, the particles had a volume average particle size of 240 nm.

[Synthesis of Hybrid Crystalline Resin HBC1]

A solution Ma1 containing the raw material monomers shown below for an addition polymerization-type resin (styrene-acrylic resin (StAc)) unit, the bireactive monomer shown below, and the radical polymerization initiator shown below was added to a dropping funnel.

| | |
|---|---|
| Styrene | 35 parts by weight |
| Butyl acrylate | 9 parts by weight |
| Acrylic acid | 4 parts by weight |
| Di-tert-butyl peroxide | 7 parts by weight |

The raw material monomers shown below for a polycondensation-type resin (crystalline polyester resin (CPEs)) unit were added to a four-necked flask quipped with a nitrogen inlet tube, a dehydration tube, a stirrer, and a thermocouple, and then dissolved by heating at 170° C. to form a solution Mb1.

| | |
|---|---|
| Adipic acid | 91 parts by weight |
| 1,9-Nonanediol | 101 parts by weight |

Subsequently, after the solution Ma1 was added under stirring dropwise to the solution Mb1 over 90 minutes and then aged for 60 minutes, the unreacted components of the solution Ma1 were removed under reduced pressure (8 kPa).

Subsequently, 0.8 parts by weight of $Ti(OBu)_4$ as an esterification catalyst was added to the resulting reaction liquid. The mixture was heated to 235° C., allowed to react under ordinary pressure (101.3 kPa) for 5 hours, and further allowed to react under reduced pressure (8 kPa) for 1 hour.

Subsequently, the resulting reaction liquid was cooled to 200° C. and then allowed to react under reduced pressure (20 kPa) for 1 hour to form a hybrid crystalline resin HBC1 having a structure in which a styrene-acrylic resin as a main chain was grafted with crystalline polyester resin side chains. The hybrid crystalline resin HBC1 had a weight average molecular weight Mw of 14,500 and a melting point Tc of 62° C.

[Synthesis of Hybrid Crystalline Resin HBC2]

The raw material monomers (inclusive of the bireactive monomer) shown below for a CPEs unit were added to a four-necked flask quipped with a nitrogen inlet tube, a dehydration tube, a stirrer, and a thermocouple, and then dissolved by heating at 170° C. to form a solution Mb2.

| | |
|---|---|
| Adipic acid | 137 parts by weight |
| 1,9-Nonanediol | 151 parts by weight |
| Methylenesuccinic acid | 12 parts by weight |

Subsequently, after 0.8 parts by weight of $Ti(OBu)_4$ as an esterification catalyst was added to the solution Mb2, the mixture was heated to 235° C., allowed to react under ordinary pressure (101.3 kPa) for 5 hours, and further allowed to react under reduced pressure (8 kPa) for 1 hour.

Subsequently, a solution Ma2 containing the raw material monomers shown below for a StAc unit and the radical polymerization initiator shown below was added to a dropping funnel.

| | |
|---|---|
| Styrene | 53 parts by weight |
| n-Butyl acrylate | 19 parts by weight |
| Di-tert-butyl peroxide | 10 parts by weight |

Subsequently, after the solution Ma2 was added under stirring dropwise to the reaction liquid from the solution Mb2 over 90 minutes and then aged for 60 minutes, the unreacted components of the solution Ma2 were removed under reduced pressure (8 kPa). In this process, the amount of the removed monomers was very small relative to the amount of the monomers in the solution Ma2.

Subsequently, the resulting reaction liquid was cooled to 170° C. and then allowed to react under reduced pressure (20 kPa) for 1 hour to form a hybrid crystalline resin HBC2 having a graft structure composed of a CPEs unit backbone and StAc unit branches. The hybrid crystalline resin HBC2 had a Mw of 15,000 and a Tc of 62° C.

[Synthesis of Hybrid Crystalline Resin HBC3]

A solution Ma3 containing the raw material monomers (inclusive of the bireactive monomer) shown below for a StAc unit and the radical polymerization initiator shown below was added to a flask equipped with a stirrer, a reflux condenser, a thermometer, and a gas flow inlet.

| | |
|---|---|
| Styrene | 34 parts by weight |
| n-Butyl acrylate | 12 parts by weight |
| Acrylic acid | 2 parts by weight |

-continued

| | |
|---|---|
| Di-tert-butyl peroxide | 7 parts by weight |
| N,N-dimethylformamide | 80 parts by weight |

Subsequently, after the atmosphere in the flask was replaced with nitrogen, the solution Ma3 was heated to 80° C. under stirring. Subsequently, after the solution was held at the same temperature for 6 hours, the solvent and the unreacted monomers were removed by distillation, so that a vinyl resin VR1 was obtained. In this process, the amount of the removed monomers of Ma3 was very small relative to the amount of the raw material monomers in the solution Ma3.

Subsequently, 290 parts by weight of adipic acid and 320 parts by weight of 1,9-nonanediol were added to a reaction vessel equipped with a stirrer, a thermometer, a condenser tube, and a nitrogen gas inlet tube. After the space in the reaction vessel was replaced with dry nitrogen gas, 0.1 parts by weight of $Ti(OBu)_4$ was further added to the vessel. The mixture was allowed to react under a nitrogen gas stream at about 180° C. for 8 hours with stirring. After 0.2 parts by weight of $Ti(OBu)_4$ was further added to the resulting reaction liquid, the mixture was allowed to react at a raised temperature of about 220° C. for 6 hours with stirring. Subsequently, after the pressure in the reaction vessel was reduced to 10 mmHg, the product was allowed to react under the reduced pressure to form a crystalline polyester resin CPEs1. CPEs1 had a Mw of 13,000.

VR1 and CPEs1 obtained as described above were subjected to block copolymerization according to the procedure described below.

First, 80 parts by weight of CPEs1 and 20 parts by weight of VR1 were added to a glass vessel equipped with a reflux condenser, a nitrogen inlet tube, and a stirrer and then dissolved by stirring at 50° C. Subsequently, 2.7 parts by weight of dichlorocarbodiimide (DCC) and 0.17 parts by weight of dimethylaminopyridine (DMAP) were added to the resulting solution. The mixture was then allowed to react at 50° C. for 2 hours to form a hybrid crystalline resin HBC3, which was a block copolymer of the vinyl resin and the crystalline polyester resin. The hybrid crystalline resin HBC3 had a Mw of 29,000 and a Tc of 62° C.

[Synthesis of Hybrid Crystalline Resin HBC4]

A hybrid crystalline resin HBC4 was obtained as in the synthesis of the hybrid crystalline resin HBC1, except that the solution Ma1 was replaced with a solution Ma4 containing the amounts of the raw material monomers, the bireactive monomer, and the radical polymerization initiator shown below. The hybrid crystalline resin HBC4 had a Mw of 15,000 and a Tc of 62° C.

| | |
|---|---|
| Styrene | 60.5 parts by weight |
| Butyl acrylate | 15.5 parts by weight |
| Acrylic acid | 7 parts by weight |
| Di-tert-butyl peroxide | 12 parts by weight |

[Synthesis of Hybrid Crystalline Resin HBC5]

The solution Mb1 was prepared at 170° C. in a four-necked flask quipped with a nitrogen inlet tube, a dehydration tube, a stirrer, and a thermocouple.

Subsequently, after 0.8 parts by weight of $Ti(OBu)_4$ as an esterification catalyst was added to the solution Mb1, the mixture was heated to 235° C., allowed to react under ordinary pressure (101.3 kPa) for 5 hours, and further allowed to react under reduced pressure (8 kPa) for 1 hour to form a crystalline polyester CPEs2.

Subsequently, the raw material monomers shown below were added to a four-necked flask equipped with a nitrogen inlet tube, a dehydration tube, a stirrer, and a thermocouple, and then dissolved by heating at 170° C. to form a solution Mb6.

| | |
|---|---|
| Propylene oxide (2 moles) adduct of bisphenol A | 31 parts by weight |
| Terephthalic acid | 8 parts by weight |
| Fumaric acid | 6 parts by weight |
| Trimellitic acid | 2.5 parts by weight |

Subsequently, after 0.4 parts by weight of $Ti(OBu)_4$ as an esterification catalyst was added to the solution Mb6, the mixture was heated to 235° C., allowed to react under ordinary pressure (101.3 kPa) for 5 hours, and further allowed to react under reduced pressure (8 kPa) for 1 hour. The whole amount of the CPEs2 was added to the resulting reaction liquid and then mixed uniformly. The mixture was then allowed to react under reduced pressure (8 kPa) for 1 hour to form a hybrid crystalline resin HBC5 having a structure in which an amorphous polyester resin as a main chain was grafted with CPEs2 side chains. The hybrid crystalline resin HBC5 had a Mw of 15,500 and a Tc of 62° C.

[Synthesis of Hybrid Crystalline Resin HBC6]

A hybrid crystalline resin HBC6 was obtained as in the synthesis of the hybrid crystalline resin HBC1, except that the solution Ma1 was replaced with a solution Ma6 containing the amounts of the raw material monomers, the bireactive monomer, and the radical polymerization initiator shown below. The hybrid crystalline resin HBC6 had a Mw of 14,000 and a Tc of 62° C.

| | |
|---|---|
| Styrene | 7.4 parts by weight |
| Butyl acrylate | 1.9 parts by weight |
| Acrylic acid | 0.8 parts by weight |
| Di-tert-butyl peroxide | 1.5 parts by weight |

Table 1 shows the material composition and melting point of each of the hybrid crystalline resins HBC1 to HBC6. In the table, "StAc" means styrene-acrylic resin, and "CPEs" means crystalline polyester. HBC3 is a linear block polymer of StAc/CPEs (20/80).

TABLE 1

| | Main chain | | Side chain | | |
|---|---|---|---|---|---|
| HBC No. | Type | Content (wt %) | Type | Content (wt %) | Tc (° C.) |
| 1 | StAc | 20 | CPEs | 80 | 62 |
| 2 | CPEs | 80 | StAc | 20 | 62 |
| 3 | StAc/CPEs | 20/80 | — | — | 62 |
| 4 | StAc | 30 | CPEs | 70 | 62 |
| 5 | APEs | 20 | CPEs | 80 | 62 |
| 6 | StAc | 5 | CPEs | 95 | 62 |

[Preparation of Aqueous Dispersion $D_{HBC1}$]

Two hundred parts by weight of the hybrid crystalline resin HBC1 was dissolved in 200 parts by weight of ethyl acetate. While the solution was stirred, an aqueous solution obtained by dissolving sodium polyoxyethylene lauryl ether sulfate at a concentration of 1% by weight in 800 parts by weight of ion-exchanged water was slowly added dropwise to the solution. After ethyl acetate was removed from the resulting solution under reduced pressure, the pH of the product was adjusted to 8.5 with ammonia. The solid concentration of the product was then adjusted to 30% by weight. In this way, a dispersion $D_{HBC1}$ was prepared containing fine particles of the hybrid crystalline resin HBC1 dispersed in the aqueous medium. The particles in the dispersion $D_{HBC1}$ had a volume median diameter of 205 nm.

[Preparation of Aqueous Dispersions $D_{HBC2}$ to $D_{HBC6}$]

Dispersions $D_{HBC2}$ to $D_{HBC6}$ each containing fine particles of each of the hybrid crystalline resins HBC2 to HBC6 dispersed in an aqueous medium were each obtained as in the preparation of the dispersion $D_{HBC1}$, except that the hybrid crystalline resins HBC2 to HBC6 were each used instead of the hybrid crystalline resin HBC1. The particles in each of the dispersions $D_{HBC2}$ to $D_{HBC6}$ had a volume median diameter in the range of 190 to 230 nm.

[Synthesis of Amorphous Resin X1 and Preparation of Aqueous Dispersion $D_{X1}$]

(First Stage Polymerization)

A 5 L reaction vessel quipped with a stirrer, a temperature sensor, a condenser tube, and a nitrogen inlet device was charged with 8 parts by weight of sodium dodecyl sulfate and 3,000 parts by weight of ion-exchanged water. While the mixture was stirred at a rate of 230 rpm under a nitrogen stream, the inner temperature was raised to 80° C. Subsequently, a solution of 10 parts by weight of potassium persulfate in 200 parts by weight of ion-exchanged water was added to the resulting solution. After the liquid temperature was raised to 80° C. again, a mixed monomer liquid composed as shown below was added dropwise to the resulting solution over 1 hour. Subsequently, the mixture was subjected to polymerization under heating and stirring at 80° C. for 2 hours to form a dispersion x1 of resin fine particles.

| | |
|---|---|
| Styrene | 480 parts by weight |
| n-Butyl acrylate | 250 parts by weight |
| Methacrylic acid | 68 parts by weight |

(Second Stage Polymerization)

A 5 L reaction vessel equipped with a stirrer, a temperature sensor, a condenser tube, and a nitrogen inlet device was charged with a solution of 7 parts by weight of sodium polyoxyethylene (2) dodecyl ether sulfate in 3,000 parts by weight of ion-exchanged water. After the solution was heated to 98° C., 260 parts by weight of the dispersion x1 of resin fine particles and a solution obtained by dissolving at 90° C. the monomers and the release agent shown below were added to the solution. The materials were then mixed and dispersed for 1 hour with a circulation path-containing mechanical disperser CLEARMIX (manufactured by M Technique Co., Ltd., "CLEARMIX" is a registered trademark of the same company) to form a dispersion containing emulsified particles (oil droplets). The release agent is behenic acid behenate (melting point 73° C.).

| | |
|---|---|
| Styrene | 284 parts by weight |
| n-Butyl acrylate | 92 parts by weight |
| Methacrylic acid | 13 parts by weight |
| n-Octyl-3-mercaptopropionate | 1.5 parts by weight |
| Behenic acid behenate | 190 parts by weight |

Subsequently, an initiator solution obtained by dissolving 6 parts by weight of potassium persulfate in 200 parts by weight of ion-exchanged water was added to the dispersion. The resulting dispersion was subjected to polymerization under heating and stirring at 84° C. for 1 hour to form a dispersion x2 of resin fine particles.

(Third stage polymerization)

Four hundred parts by weight of ion-exchanged water was further added to the dispersion x2 of resin fine particles and thoroughly mixed. A solution of 11 parts by weight of potassium persulfate in 400 parts by weight of ion-exchanged water was then added to the resulting mixture liquid. A mixed monomer liquid composed as shown below was added dropwise to the resulting dispersion under the temperature conditions of 82° C. over 1 hour.

| | |
|---|---|
| Styrene | 350 parts by weight |
| n-Butyl acrylate | 215 parts by weight |
| Acrylic acid | 30 parts by weight |
| n-Octyl-3-mercaptopropionate | 8 parts by weight |

After the dropwise addition was completed, the mixture was subjected to polymerization under heating and stirring for 2 hours. The resulting reaction liquid was then cooled to 28° C. to give a dispersion $D_{X1}$ containing an amorphous vinyl resin X1 and fine particles of the resin X1 dispersed in the aqueous medium.

The fine particles in the aqueous dispersion $D_{X1}$ had a volume median diameter of 220 nm. The amorphous resin X1 had a glass transition temperature Tg1 of 55° C. and a Mw of 32,000.

[Synthesis of Amorphous Resin X2]

The raw material monomers shown below for a polycondensation-type resin (amorphous polyester resin) unit were added to a four-necked flask quipped with a nitrogen inlet tube, a dehydration tube, a stirrer, and a thermocouple, and then dissolved by heating at 170° C.

| | |
|---|---|
| Propylene oxide (2 moles) adduct of bisphenol A | 285.7 parts by weight |
| Terephthalic acid | 66.9 parts by weight |
| Fumaric acid | 47.4 parts by weight |

Subsequently, 0.4 parts by weight of $Ti(OBu)_4$ as an esterification catalyst was added to the resulting solution. The mixture was heated to 235° C., allowed to react under ordinary pressure (101.3 kPa) for 5 hours, and further allowed to react under reduced pressure (8 kPa) for 1 hour.

Subsequently, the resulting reaction liquid was cooled to 200° C. and then allowed to react under reduced pressure (20 kPa) until the desired softening point was reached. Subsequently, the solvent was removed, so that an amorphous resin X2 was obtained. The amorphous resin X2 had a glass transition temperature Tg1 of 61° C. and a Mw of 19,000.

[Preparation of Aqueous Dispersion $D_{X2}$]

One hundred parts by weight of the amorphous resin X2 was dissolved in 400 parts by weight of ethyl acetate (manufactured by KANTO CHEMICAL CO., INC.). The resulting solution was mixed with 638 parts by weight of a 0.26% by weight sodium lauryl sulfate solution, which was prepared in advance. With stirring, the mixture was subjected to ultrasonic dispersion for 30 minutes using an ultrasonic homogenizer US-150T (manufactured by NIHONSEIKI KAISHA LTD.) at V-LEVEL 300 μA. Subsequently, using a diaphragm vacuum pump V-700 (manufactured by BUCHI Corporation) being heated at 40° C., the ethyl acetate was completely removed from the dispersion being stirred under reduced pressure for 3 hours. As a result, a dispersion $D_{X2}$ was obtained containing fine particles of the amorphous resin X2 dispersed at a solid content of 13.5% by weight in the aqueous medium. The particles in the dispersion $D_{X2}$ had a volume median diameter of 190 nm.

[Preparation of Aqueous Dispersion $D_{Cy}$ of Colorant Fine Particles]

Ninety parts by weight of sodium dodecyl sulfate was added to 1,600 parts by weight of ion-exchanged water. While the resulting solution was stirred, 420 parts by weight of copper phthalocyanine was gradually added to the solution. The mixture was then dispersed using a stirrer CLEARMIX (manufactured by M Technique Co., Ltd.) to give an aqueous dispersion $D_{Cy}$ of colorant fine particles. The colorant fine particles in the dispersion $D_{Cy}$ had an average particle size (volume median diameter) of 110 nm.

[Preparation of Aqueous Nucleating Agent Dispersion $D_{cc1}$]

Ninety parts by weight of sodium dodecyl sulfate was added to 1,600 parts by weight of ion-exchanged water. While the resulting solution was stirred, 420 parts by weight of arachidyl alcohol was gradually added to the solution. The mixture was then dispersed using a stirrer CLEARMIX (manufactured by M Technique Co., Ltd.) to give an aqueous nucleating agent dispersion $D_{cc1}$. The nucleating agent (arachidyl alcohol) in the dispersion $D_{cc1}$ had an average particle size (volume median diameter) of 110 nm.

[Preparation of Aqueous Nucleating Agent Dispersions $D_{cc2}$ to $D_{cc11}$]

Aqueous nucleating agent dispersions $D_{cc2}$ to $D_{cc11}$ were each prepared as in the preparation of the dispersion Dcc1, except that arachidyl alcohol was replaced with each of behenyl alcohol, 1-tetracosanol, 1-hexacosanol, octacosanol, palmitic acid, margaric acid, stearic acid, arachidic acid, behenic acid, and lignoceric acid. The nucleating agent in each of the aqueous nucleating agent dispersions $D_{cc2}$ to $D_{cc11}$ had an average particle size (volume median diameter) in the range of 100 to 250 nm.

Example 1

Production of Cyan Developer 1

A reaction vessel equipped with a stirrer, a temperature sensor, and a condenser tube was charged with 180 parts by weight (on a solid basis) of the dispersion $D_{X1}$, 20 parts by weight (on a solid basis) of the dispersion $D_{HBC1}$, and 2,000 parts by weight of ion-exchanged water. The pH of the mixture was then adjusted to 10 by adding a 5 mol/liter sodium hydroxide aqueous solution.

Subsequently, 30 parts by weight (on a solid basis) of the dispersion $D_{Cy}$ was added to the resulting dispersion, which was followed by adding 10 parts by weight (on a solid basis) of the dispersion $D_{cc1}$. Subsequently, an aqueous solution obtained by dissolving 60 parts by weight of magnesium chloride in 60 parts by weight of ion-exchanged water was added to the resulting dispersion under stirring at 30° C. over 10 minutes. Subsequently, the dispersion was allowed to stand for 3 minutes and then started to be heated. The resulting dispersion was heated to 80° C. over 60 minutes and then held at 80° C. where the particle growth reaction was continued.

In this state, the size of the aggregate particles was measured with Coulter Multisizer 3 (manufactured by Beckman Coulter, Inc.). At the point when the volume median diameter of the aggregate particles reached 6.4 μm, an aqueous solution obtained by dissolving 190 parts by weight of sodium chloride in 760 parts by weight of ion-exchanged water was added to the dispersion in the reaction vessel so that the particle growth was stopped.

The temperature was further raised, and the fusion of the particles was allowed to proceed by heating and stirring at 90° C. The dispersion in the reaction vessel was cooled at a rate of 2.5° C./min to 30° C. at the point when the average circularity of the particles (the HPF detection number was 4,000) reached 0.945 as measured using an average circularity measurement system FPIA-2100 (manufactured by Sysmex Corporation).

Subsequently, the dispersion was subjected to solid-liquid separation. The toner cake was washed by repeating three times the operation of re-dispersing the dehydrated toner cake in ion-exchanged water and subjecting the dispersion to solid-liquid separation. The toner cake was then dried at 40° C. for 24 hours to give cyan toner base particles 1X. The microstructure of the cyan toner base particles 1X was observed with a TEM as described above. As a result, a sea-island structure was observed in which the CPEs and the nucleating agent formed dispersed phases (domains) while the amorphous resin formed a continuous phase (matrix).

Subsequently, 0.6 parts by weight of hydrophobic silica (12 nm in number average primary particle size, 68 in hydrophobicity) and 1.0 parts by weight of hydrophobic titanium oxide (20 nm in number average primary particle size, 63 in hydrophobicity) were added to 100 parts by weight of the cyan toner base particles 1X. The materials were mixed at 32° C. for 20 minutes using a Henschel mixer (manufactured by NIPPON COKE & ENGINEERING CO., LTD.) at a rotor speed of 35 mm/sec. Coarse particles were then removed from the mixture using a 45-μm-opening sieve. After this treatment with the external additives, cyan toner particles 1 were obtained. The cyan toner base particles 1 and the cyan toner particles 1 both had a volume average particle size of 6.3 μm.

Silicone resin-coated ferrite carrier particles with a volume average particle size of 60 μm were added to and mixed with the cyan toner particles 1 in such a way that the concentration of the toner particles reached 6% by weight, so that a cyan developer 1 as a two-component developer was obtained.

Examples 2 to 11

Production of Cyan Developers 2 to 11

Cyan developers 2 to 11 were each produced as in the production of the cyan developer 1, except that the dispersions $D_{cc2}$ to $D_{cc11}$ were each used instead of the dispersion $D_{cc1}$.

The microstructure of the toner base particles 2X to 11X in the cyan developers 2 to 11, respectively, was observed with a TEM as described above. As a result, it was observed that the cyan toner base particles of each developer had a sea-island structure in which the CPEs and the nucleating agent formed dispersed phases (domains) while the amorphous resin formed a continuous phase (matrix). The cyan toner base particles 2X to 11X had the same volume average particle size as the corresponding cyan toner particles, and all the volume average particle sizes were in the range of 6.0 to 6.5 μm.

Examples 12 and 13

Production of Cyan Developers 12 and 13

A cyan developer 12 was produced as in the production of the cyan developer 8, except that the added amount of the dispersion $D_{cc8}$ was changed to 1 part by weight (on a solid basis). A cyan developer 13 was produced as in the production of the cyan developer 8, except that the added amount of the dispersion $D_{cc8}$ was changed to 20 parts by weight (on a solid basis).

The microstructure of the toner base particles 12X and 13X in the cyan developers 12 and 13, respectively, was observed with a TEM as described above. As a result, it was observed that the cyan toner base particles 12X and 13X both had a sea-island structure in which the CPEs and the nucleating agent formed dispersed phases (domains) while the amorphous resin formed a continuous phase (matrix). The cyan toner base particles 12X and 13X had the same volume average particle size as the corresponding cyan toner particles, and all the volume average particle sizes were in the range of 6.0 to 6.5 μm.

Examples 14 and 15

Production of Cyan Developers 14 and 15

A cyan developer 14 was produced as in the production of the cyan developer 8, except that the added amount of the dispersion $D_{HBC1}$ was changed to 10 parts by weight (on a solid basis). A cyan developer 15 was produced as in the production of the cyan developer 8, except that the added amount of the dispersion $D_{HBC1}$ was changed to 60 parts by weight (on a solid basis).

The microstructure of the toner base particles 14X and 15X in the cyan developers 14 and 15, respectively, was observed with a TEM as described above. As a result, it was observed that the cyan toner base particles 14X and 15X both had a sea-island structure in which the CPEs and the nucleating agent formed dispersed phases (domains) while the amorphous resin formed a continuous phase (matrix). The cyan toner base particles 14X and 15X had the same volume average particle size as the corresponding cyan toner particles, and all the volume average particle sizes were in the range of 6.0 to 6.5 μm.

Examples 16 to 18

Production of Cyan Developers 16 to 18

A cyan developer 16 was produced as in the production of the cyan developer 8, except that the dispersion $D_{HBC2}$ was used instead of the dispersion $D_{HBC1}$. A cyan developer 17 was produced as in the production of the cyan developer 8, except that the dispersion $D_{HBC3}$ was used instead of the dispersion $D_{HBC1}$. A cyan developer 18 was produced as in the production of the cyan developer 8, except that the dispersion $D_{HBC5}$ was used instead of the dispersion $D_{HBC1}$ and the added amount of the dispersion $D_{cc8}$ was changed to 20 parts by weight (on a solid basis).

The microstructure of the toner base particles 16X and 17X in the cyan developers 16 and 17, respectively, was observed with a TEM as described above. As a result, it was observed that both cyan toner base particles had a sea-island structure in which the CPEs and the nucleating agent formed dispersed phases (domains) while the amorphous resin formed a continuous phase (matrix). The microstructure of the toner base particles 18X in the cyan developer 18 was observed with a TEM as described above. As a result, no sea-island structure was observed. The cyan toner base particles 16X to 18X had the same volume average particle size as the corresponding cyan toner particles, and all the volume average particle sizes were in the range of 6.0 to 6.5 μm.

Example 19

Production of Cyan Developer 19

A reaction vessel equipped with a stirrer, a temperature sensor, and a condenser tube was charged with 180 parts by weight (on a solid basis) of the dispersion $D_{X2}$, 20 parts by weight (on a solid basis) of the dispersion $D_{HBC1}$, and 2,000 parts by weight of ion-exchanged water. The pH of the resulting dispersion was then adjusted to 10 by adding a 5 mol/liter sodium hydroxide aqueous solution to the dispersion.

Subsequently, 30 parts by weight (on a solid basis) of the dispersion $D_{Cy}$, 43 parts by weight (on a solid basis) of the dispersion $D_{W}$, and 10 parts by weight (on a solid basis) of the dispersion $D_{cc1}$ were added to the resulting dispersion. Subsequently, an aqueous solution obtained by dissolving 60 parts by weight of magnesium chloride in 60 parts by weight of ion-exchanged water was added to the resulting dispersion under stirring at 30° C. over 10 minutes. Subsequently, the dispersion was allowed to stand for 3 minutes and then started to be heated. The resulting dispersion was heated to 80° C. over 60 minutes and then held at 80° C. where the particle growth reaction was continued.

Subsequently, the stopping of the particle growth, the fusion of the particles, solid-liquid separation, washing, and drying were performed as in the production of the cyan toner base particles 1X, so that cyan toner base particles 19X were obtained. Subsequently, the external additive treatment and the mixing with ferrite carrier particles were performed as in Example 1, so that a cyan developer 19 was obtained. The microstructure of the toner base particles 19X in the cyan developer 19 was observed with a TEM as described above. As a result, a sea-island structure was observed in which the CPEs and the nucleating agent formed dispersed phases (domains) while the amorphous resin formed a continuous phase (matrix). The cyan toner base particles 19X had a volume average particle size of 6.3 μm, which was the same as that of the cyan toner particles.

Examples 20 and 21

Production of Cyan Developers 20 and 21

A cyan developer 20 was produced as in the production of the cyan developer 8, except that the dispersion $D_{HBC6}$ was used instead of the dispersion $D_{HBC1}$. A cyan developer 21 was produced as in the production of the cyan developer 8, except that the added amount of the dispersion $D_{HBC1}$ was changed to 2 parts by weight (on a solid basis).

The microstructure of the toner base particles 20X in the cyan developer 20 was observed with a TEM as described above. As a result, a sea-island structure was observed in which the CPEs and the nucleating agent formed dispersed phases (domains) while the amorphous resin formed a continuous phase (matrix). The microstructure of the toner base particles 21X in the cyan developer 21 was observed with a TEM as described above. As a result, no sea-island structure was observed. The cyan toner base particles 20X and 21X had the same volume average particle size as the corresponding cyan toner particles, and all the volume average particle sizes were in the range of 6.0 to 6.5 μm.

Comparative Example 1

Production of Cyan Developer 22

A cyan developer 22 was obtained as in Example 1, except that the dispersion $D_{cc1}$ was not used. The cyan toner base particles 22X in the resulting cyan developer 22 had a volume average particle size of 6.4 μm, which was the same as that of the cyan toner particles.

Comparative Example 2

Production of Black Developer 1

(1) Preparation of Resin Fine Particles

A solution obtained by dissolving 7 parts by weight of sodium polyoxyethylene (2) dodecyl ether sulfate in 2,900 parts by weight of ion-exchanged water was added to a reaction vessel equipped with a stirrer, a temperature sensor, a condenser tube, and a nitrogen inlet device. After the reaction vessel was heated to 80° C., the polymerizable monomer mixture liquid composed as shown below was added without any modification to the reaction vessel. The materials were then mixed and dispersed for 1 hour with a circulation path-containing mechanical disperser CLEARMIX (manufactured by M Technique Co., Ltd.) to forma dispersion containing emulsified particles (oil droplets). The "stearyl stearate" shown below is a monoester compound, and the "distearyl adipate" shown below is a di/tri-ester compound.

| | |
|---|---|
| Styrene | 630 parts by weight |
| n-Butyl acrylate | 164 parts by weight |
| Methacrylic acid | 46 parts by weight |
| n-Octyl-3-mercaptopropionate | 7 parts by weight |
| Stearyl stearate | 80 parts by weight |
| Distearyl adipate | 80 parts by weight |
| Dibenzylidenesorbitol | 30 parts by weight |

Subsequently, a polymerization initiator solution obtained by dissolving 3 parts by weight of potassium persulfate in 100 parts by weight of ion-exchanged water was added to the dispersion. The mixture was subjected to polymerization under heating and stirring at 82° C. for 2 hours to form a dispersion of fine particles of a resin X3. The product is named a "dispersion $D_{X3}$." The SP value of the styrene-acrylic resin in resin fine particles with no monoester compound or di/tri-ester compound was calculated to be 9.5.

(2) Preparation of Dispersion of Colorant Fine Particles

Ninety parts by weight of sodium dodecyl sulfate was added to 1,600 parts by weight of ion-exchanged water. While the resulting solution was stirred, 420 parts by weight of carbon black Regal 330R (manufactured by Cabot Corporation) was gradually added to the solution. The mixture was then dispersed using a stirrer CLEARMIX (manufactured by M Technique Co., Ltd.) to give a dispersion $D_k$ of colorant fine particles (carbon black). The colorant fine particles in the dispersion $D_k$ had a particle size of 110 nm as measured with an electrophoretic light-scattering photometer ELS-800 (manufactured by Otsuka Electronics Co., Ltd.).

(3) Preparation of Toner Particles

An aqueous solution obtained by adding the amounts of the components shown below to 120 parts by weight of ion-exchanged water was added to a reaction vessel equipped with a stirrer, a temperature sensor, a condenser tube, and a nitrogen inlet device, and the liquid temperature was adjusted to 30° C.

| | |
|---|---|
| Dispersion $D_{X3}$ | 1,200 parts by weight (on a solid basis) |
| Dispersion $D_k$ | 120 parts by weight (on a solid basis) |
| Ion-exchanged water | 1,400 parts by weight |
| Sodium polyoxyethylene (2) dodecyl ether sulfate | 3 parts by weight |

Subsequently, the pH of the aqueous solution in the reaction vessel was adjusted to 10 by adding a 5 mol/liter sodium hydroxide aqueous solution to the solution. Subsequently, an aqueous solution obtained by dissolving 35 parts by weight of magnesium chloride in 35 parts by weight of ion-exchanged water was added at 30° C. to the resulting aqueous solution in the reaction vessel with stirring over 10 minutes. The solution started to be heated 3 minutes after the addition and then heated to 85° C. over 60 minutes so that the aggregation of the fine particles in the dispersion was allowed to proceed.

The size of the particles formed by the aggregation was observed with Multisizer 3. At the point when the volume median diameter (D50) of the particles reached 6.5 μm, the aggregation was stopped by adding 500 parts by weight of a 20% by weight sodium chloride aqueous solution to the dispersion in the reaction vessel. After the addition of the 20% by weight sodium chloride aqueous solution, the stirring of the dispersion was continued at a liquid temperature of 80° C., where the fusion of the particles was allowed to proceed while the average circularity of the particles formed by the aggregation was observed with Flow Particle Image Analyzer FPIA-2100. Subsequently, when the particles were determined to have an average circularity of 0.965, the liquid in the reaction vessel was cooled to a temperature of 30° C. The pH of the dispersion in the reaction vessel was then adjusted to 3.0 by adding hydrochloric acid to the dispersion, and the stirring was stopped, so that black toner base particles were obtained.

Subsequently, the external additive treatment and the mixing with ferrite carrier particles were performed as in Example 1, so that a black developer 1 was obtained. The black toner base particles in the black developer 1 had a volume average particle size of 6.5 μm, which was the same as that of the black toner particles.

[Evaluation of Cyan Developers 1 to 22 and Black Developer 1]

(1) Low-Temperature Fixability

An evaluation machine was loaded with the cyan developer 1. The evaluation machine was obtained by modifying the fixing unit of a copying machine bizhub PRO C6501 (manufactured by KONICA MINOLTA, INC., "bizhub" is a registered trademark of the same company) in such a way that the surface temperature of the fixing heat roller could be changed in the range of 100 to 210° C. Using the evaluation machine, a fixing experiment was then performed, in which solid images were fixed with a toner deposition amount of 11 mg/10 $cm^2$ on OK Embossed-Texture sheets (basis weight 104.7 $g/m^2$) manufactured by Oji Paper Co., Ltd. The fixing experiment was repeated until the fixing temperature reached 120° C., while the set fixing temperature was changed and increased by 5° C. from 85° C. to 120° C. The experiment was also performed using each of the cyan developers 2 to 22 and the black developer 1.

The pints obtained in the experiment were then folded by a folding machine in such a way that a load was applied to the solid image, onto which compressed air at 0.35 MPa was blown. The fold was ranked on a score of 1 to 5 according to the evaluation criteria shown below. In the evaluation, the lower-limit fixing temperature was used, which was defined as the lowest fixing temperature in the fixing experiment where a score of 3 was obtained. The lower the lower-limit fixing temperature is, the better the low-temperature fixability will be. A lower-limit fixing temperature of 120° C. or lower is practically acceptable and evaluated as being acceptable.

(Evaluation Criteria)

5: No peeling is observed at the fold.

4: Partial peeling is observed along the fold.

3: Thin line-shaped peeling is observed along the fold.

2: Thick line-shaped peeling is observed along the fold.

1: Large peeing is observed.

(2) Evaluation of High-Temperature Storage Stability

To a 10 mL glass vial with an inner diameter of 21 mm was added 0.5 g of each of the cyan developers 1 to 22 and the black developer 1. The vial was capped and then shaken 600 times at room temperature in Tap Denser KYT-2000 (manufactured by Seishin Enterprise Co., Ltd.). Subsequently, the vial was uncapped and then allowed to stand for 2 hours in an environment at 55° C. and 35% RH.

Subsequently, the developer after the standing was placed on a 48-mesh (opening 350 μm) sieve so carefully that the aggregates of the developer were not disintegrated. The sieve was then placed in a powder tester (manufactured by HOSOKAWA MICRON CORPORATION) and fixed with a holding bar and a knob nut. After the sieve was vibrated for 10 seconds with an adjusted 1-mm-feed-width vibration intensity, the ratio of the amount of the developer remaining on the sieve (the toner aggregation rate At (% by weight)) was determined. At is the value calculated from the following formula.

At (% by weight)=(the weight (g) of the developer remaining on the sieve)/0.5 (g)×100

Using the calculated At, the high-temperature storage stability of the developer was evaluated according to the criteria below. The toner with a score of ● to Δ is evaluated as being acceptable.

(Evaluation Criteria)

⊙: The toner aggregation rate is less than 15% by weight (the developer has very good heat-resistant storage stability).

○: The toner aggregation rate is from 15% by weight to less than 20% by weight (the developer has good heat-resistant storage stability).

Δ: The toner aggregation rate is from 20% by weight to less than 25% by weight (the developer has slightly poor heat-resistant storage stability).

X: The toner aggregation rate is 25% by weight or more (the developer has poor heat-resistant storage stability and is not acceptable for use).

(3) Uniform Chargeability (Half-Tone Reproducibility)

Using each of the cyan developers 1 to 22 and the black developer 1, a half-tone chart was copied by the evaluation machine. The image density was measured at five points of the resulting image along the axial direction of the photoreceptor. The variation in image density was calculated from the measurements. The image density was measured using an image densitometer (Macbeth RD914). The variation in image density was calculated as the ratio (%) of the difference between the maximum and minimum of the measurements at the five points to the average of the five measurements. Using the variation in image density, the half-tone reproducibility was evaluated based on the evaluation criteria below for the evaluation of the uniform chargeability of the toner. The toner with a score of ⊙ to Δ is evaluated as being acceptable.

(Evaluation Criteria)

⊙: The variation in image density is less than 10% (very good).

○: The variation in image density is from 10% to less than 15% (good).

Δ: The variation in image density is from 15% to less than 20%.

X: The variation in image density is 20% or more.

Table 2 shows the composition of the binder resin in each of the cyan developers 1 to 22 and the black developer 1, and Table 3 shows the results of the evaluation, respectively. In Table 2, "HBC" and "X" mean hybrid crystalline resin and amorphous resin, respectively. In Table 2, the amount of the nucleating agent is based on 100 parts by weight of the resin.

TABLE 2

| | | Hybrid crystalline resin | | Amorphous resin | | Nucleating agent | | |
|---|---|---|---|---|---|---|---|---|
| | Developer No. | Type | Content (wt %) | Type | Content (wt %) | Type | Melting point (° C.) | Content (wt parts) |
| Example 1 | Cyan 1 | HBC1 | 10 | X1 | 90 | Arachidyl alcohol | 64 | 5 |
| Example 2 | Cyan 2 | HBC1 | 10 | X1 | 90 | Behenyl alcohol | 66 | 5 |
| Example 3 | Cyan 3 | HBC1 | 10 | X1 | 90 | 1-Tetracosanol | 77 | 5 |
| Example 4 | Cyan 4 | HBC1 | 10 | X1 | 90 | 1-Hexacosanol | 79 | 5 |
| Example 5 | Cyan 5 | HBC1 | 10 | X1 | 90 | Octacosanol | 82 | 5 |
| Example 6 | Cyan 6 | HBC1 | 10 | X1 | 90 | Palmitic acid | 63 | 5 |
| Example 7 | Cyan 7 | HBC1 | 10 | X1 | 90 | Margaric acid | 61 | 5 |
| Example 8 | Cyan 8 | HBC1 | 10 | X1 | 90 | Stearic acid | 70 | 5 |
| Example 9 | Cyan 9 | HBC1 | 10 | X1 | 90 | Arachidic acid | 76 | 5 |
| Example 10 | Cyan 10 | HBC1 | 10 | X1 | 90 | Behenic acid | 75 | 5 |
| Example 11 | Cyan 11 | HBC1 | 10 | X1 | 90 | Lignoceric acid | 86 | 5 |
| Example 12 | Cyan 12 | HBC1 | 10 | X1 | 90 | Stearic acid | 70 | 0.5 |
| Example 13 | Cyan 13 | HBC1 | 10 | X1 | 90 | Stearic acid | 70 | 10 |
| Example 14 | Cyan 14 | HBC1 | 5 | X1 | 95 | Stearic acid | 70 | 5 |
| Example 15 | Cyan 15 | HBC1 | 30 | X1 | 70 | Stearic acid | 70 | 5 |
| Example 16 | Cyan 16 | HBC2 | 10 | X1 | 90 | Stearic acid | 70 | 5 |
| Example 17 | Cyan 17 | HBC3 | 10 | X1 | 90 | Stearic acid | 70 | 5 |
| Example 18 | Cyan 18 | HBC5 | 100 | — | — | Stearic acid | 70 | 10 |
| Example 19 | Cyan 19 | HBC4 | 10 | X2 | 90 | Stearic acid | 70 | 5 |

TABLE 2-continued

| | Developer No. | Hybrid crystalline resin Type | Hybrid crystalline resin Content (wt %) | Amorphous resin Type | Amorphous resin Content (wt %) | Nucleating agent Type | Nucleating agent Melting point (° C.) | Nucleating agent Content (wt parts) |
|---|---|---|---|---|---|---|---|---|
| Example 20 | Cyan 20 | HBC6 | 10 | X1 | 90 | Stearic acid | 70 | 5 |
| Example 21 | Cyan 21 | HBC1 | 1 | X1 | 99 | Stearic acid | 70 | 5 |
| Comparative Example 1 | Cyan 22 | HBC1 | 10 | X1 | 90 | — | — | — |
| Comparative Example 2 | Black 1 | — | — | X3 | 100 | Dibenzylidenesorbitol | 225 | 3 |

TABLE 3

| | Developer No. | Evaluations: Low-temperature fixability | High-temperature storage stability | Half-tone reproducibility |
|---|---|---|---|---|
| Example 1 | Cyan 1 | 95 | ⊙ | Δ |
| Example 2 | Cyan 2 | 95 | ○ | ⊙ |
| Example 3 | Cyan 3 | 105 | ○ | ○ |
| Example 4 | Cyan 4 | 105 | ○ | Δ |
| Example 5 | Cyan 5 | 110 | ○ | Δ |
| Example 6 | Cyan 6 | 95 | ○ | Δ |
| Example 7 | Cyan 7 | 95 | Δ | Δ |
| Example 8 | Cyan 8 | 90 | ⊙ | ⊙ |
| Example 9 | Cyan 9 | 100 | ⊙ | ○ |
| Example 10 | Cyan 10 | 100 | ⊙ | ⊙ |
| Example 11 | Cyan 11 | 105 | ○ | Δ |
| Example 12 | Cyan 12 | 105 | Δ | ○ |
| Example 13 | Cyan 13 | 100 | ○ | ○ |
| Example 14 | Cyan 14 | 100 | ○ | Δ |
| Example 15 | Cyan 15 | 95 | ⊙ | Δ |
| Example 16 | Cyan 16 | 120 | Δ | ○ |
| Example 17 | Cyan 17 | 120 | Δ | Δ |
| Example 18 | Cyan 18 | 85 | Δ | Δ |
| Example 19 | Cyan 19 | 90 | ○ | ⊙ |
| Example 20 | Cyan 20 | 100 | ⊙ | Δ |
| Example 21 | Cyan 21 | 105 | Δ | Δ |
| Comparative Example 1 | Cyan 22 | 105 | X | X |
| Comparative Example 2 | Black 1 | 125 | X | X |

Table 3 shows that the cyan developers 1 to 21 of Examples 1 to 21 all have sufficient performance on low-temperature fixability, high-temperature storage stability, and uniform chargeability.

It is also apparent, for example, from Examples 1 to 11 that arachidyl alcohol, behenyl alcohol, 1-tetracosanol, 1-hexacosanol, octacosanol, palmitic acid, margaric acid, stearic acid, arachidic acid, behenic acid, and lignoceric acid are effective nucleating agents.

It is also apparent, for example, from Examples 1 to 11 that a difference (Tcc−Tc) of 8° C. or less between the melting point Tcc of the nucleating agent and the melting point Tc of the hybrid crystalline resin is effective in improving the low-temperature fixability, a melting point difference (Tcc−Tc) of at least 2 to 14° C. is effective in improving the high-temperature storage stability, and a melting point difference (Tcc−Tc) of at least 4 to 13° C. is effective in improving the uniform chargeability.

It is also apparent, for example, from Examples 8, 16, and 17 that the hybrid crystalline resin having a structure in which the amorphous resin unit is grafted with the crystalline polyester resin unit is more effective in improving all the low-temperature fixability, the high-temperature storage stability, and the uniform chargeability.

It is also apparent, for example, from Examples 1, 6, and 7 that the nucleating agent with a melting point higher than that of the hybrid crystalline resin is more effective in improving the high-temperature storage stability.

It is also apparent, for example, from Examples 8, 19, and 20 that the hybrid crystalline resin having an amorphous resin unit content of 5 to 30% by weight is more effective in improving both the low-temperature fixability and the high-temperature storage stability. It is observed that the uniform chargeability tends to be higher as the content of the amorphous resin unit in the hybrid crystalline resin increases in the range mentioned above.

It is also apparent, for example, from Examples 8, 14, 15, 18, and 21 that the binder resin having a hybrid crystalline resin content of 1 to 30% by weight is more effective in improving the high-temperature storage stability.

It is also apparent, for example, from Examples 8, 18, and 19 that the binder resin further including an amorphous resin is more effective in improving both the high-temperature storage stability and the uniform chargeability and that when the amorphous resin is a vinyl resin, a more significant effect is obtained in this regard.

It is also apparent, for example, from Examples 8, 12, and 13 that the nucleating agent present at a content of 0.5 to 10% by weight in the toner base particles is more effective in improving all the low-temperature fixability, the high-temperature storage stability, and the uniform chargeability. It is observed that the high-temperature storage stability tends to decrease as the nucleating agent content decreases and that the low-temperature fixability, the high-temperature storage stability, and the uniform chargeability generally tend to decrease as the nucleating agent content increases.

On the other hand, Comparative Example 1 is insufficient in both high-temperature storage stability and uniform chargeability. This is probably because the toner base particles contain no nucleating agent.

Comparative Example 2 is insufficient in low-temperature fixability and high-temperature storage stability. This is probably because the binder resin does not contain the hybrid crystalline resin so that the low-temperature fixability is poor and because the nucleating agent in the toner base particles has too high a melting point so that the nucleating agent does not substantially act and thus has substantially no effect on the low-temperature fixability or the high-temperature storage stability.

According to the present invention, the toner has good low-temperature fixability and uniform chargeability, and unintentional external heat-induced compatibilization of binder resin components can be suppressed. The present invention is expected to achieve higher performance, higher speed, and lower energy consumption in electrophotographic image forming techniques, to improve the versatility of toner, and to achieve wider use of such image forming techniques.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An electrostatic latent image developing toner comprising: toner base particles comprising a binder resin and a nucleating agent, wherein the binder resin comprises a hybrid crystalline resin having a structure in which a crystalline polyester resin unit and an amorphous resin unit are chemically bonded to each other, and the nucleating agent is at least one compound selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid.

2. The toner according to claim 1, wherein the hybrid crystalline resin has a structure in which the amorphous resin unit is grafted with the crystalline polyester resin unit.

3. The toner according to claim 1, wherein the nucleating agent has a melting point higher than that of the hybrid crystalline resin.

4. The toner according to claim 1, wherein the hybrid crystalline resin contains 5 to 30% by weight of the amorphous resin unit.

5. The toner according to claim 1, wherein the binder resin contains 1 to 30% by weight of the hybrid crystalline resin.

6. The toner according to claim 1, wherein the binder resin further comprises an amorphous resin.

7. The toner according to claim 6, wherein the amorphous resin is a vinyl resin.

8. A method of producing an electrostatic latent image developing toner comprising toner base particles comprising a binder resin and a nucleating agent, the method comprising the step of growing particles that are produced by aggregating particles of the binder resin and particles of the nucleating agent in an aqueous medium, wherein a hybrid crystalline resin having a structure in which a crystalline polyester resin unit and an amorphous resin unit are chemically bonded to each other is used to form the binder resin, and at least one compound selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid is used as the nucleating agent.

9. The method according to claim 8, wherein a resin having a structure in which the amorphous resin unit is grafted with the crystalline polyester resin unit is used as the hybrid crystalline resin.

10. The method according to claim 8, wherein a compound having a melting point higher than that of the hybrid crystalline resin is used as the nucleating agent.

11. The method according to claim 8, wherein the hybrid crystalline resin contains 5 to 30% by weight of the amorphous resin unit.

12. The method according to claim 8, wherein the binder resin contains 1 to 30% by weight of the hybrid crystalline resin.

13. The method according to claim 8, wherein an amorphous resin is further used to form the binder resin.

14. The method according to claim 13, wherein a vinyl resin is used as the amorphous resin.

* * * * *